US007096918B2

(12) United States Patent
Lin

(10) Patent No.: US 7,096,918 B2
(45) Date of Patent: Aug. 29, 2006

(54) WINDING DEVICE FOR A WINDOW BLIND

(76) Inventor: Ke-Min Lin, No. 18, Tai-Shan 2nd St., West Dist., Chiayi City (TW)

( * ) Notice: Subject to any disclaimer, the term of this patent is extended or adjusted under 35 U.S.C. 154(b) by 183 days.

(21) Appl. No.: 10/958,024

(22) Filed: Oct. 4, 2004

(65) Prior Publication Data

US 2006/0070706 A1 Apr. 6, 2006

(51) Int. Cl.
*E06B 9/30* (2006.01)

(52) U.S. Cl. ..... 160/171

(58) Field of Classification Search ..... 160/171, 160/170, 168.1 R, 172 R, 173 R, 177 R, 160/178.1 R, 84.01, 84.04, 84.05, 84.06
See application file for complete search history.

(56) References Cited

U.S. PATENT DOCUMENTS 2,250,106 A * 7/1941 Lorentzen ..... 160/170
2,765,030 A * 10/1956 Bechtler ..... 160/170
3,141,497 A * 7/1964 Griesser ..... 160/170
5,103,888 A * 4/1992 Nakamura ..... 160/171
5,328,113 A 7/1994 de Chevron Villette et al.
5,645,118 A * 7/1997 Lagarde ..... 160/170
5,908,062 A * 6/1999 Fun ..... 160/170
6,655,441 B1 * 12/2003 Wen et al. ..... 160/168.1 P
6,659,156 B1 * 12/2003 Wen et al. ..... 160/168.1 P
6,662,850 B1 * 12/2003 Chung et al. ..... 160/171
6,918,424 B1 * 7/2005 Lin ..... 160/171

* cited by examiner

*Primary Examiner*—David Purol
(74) *Attorney, Agent, or Firm*—Frommer Lawrence & Haug LLP; Ronald R. Santucci

(57) ABSTRACT

A winding device includes a headrail, a winding drum, a pull cord, a carriage member, and a guide member. The winding drum is mounted on the headrail, is operable so as to rotate relative to the headrail, and has threaded and smooth drum portions. The pull cord extends through the headrail and is secured to the smooth drum portion. The carriage member threadedly engages the threaded drum portion, and is movable along the threaded drum portion when the winding drum is rotated so as to wind the pull cord on the smooth drum portion. The guide member is coupled to the carriage member so as to be co-movable therewith, and guides the pull cord such that winding turns of the pull cord on the smooth drum portion are formed adjacent to one another without overlapping.

10 Claims, 6 Drawing Sheets

WINDING DEVICE FOR A WINDOW BLIND

BACKGROUND OF THE INVENTION

1. Field of the Invention

The invention relates to a winding device, more particularly to a winding device for a window blind 2. Description of the Related Art U.S. Pat. No. 5,328,113 discloses a conventional winding device for winding an end portion of a pull cord of a window blind. The conventional winding device includes a winding drum, and an auxiliary drum that extends from the winding drum. The end portion of the pull cord is secured to the winding drum. The auxiliary drum has a diameter larger than that of the winding drum, and a distal end distal from the winding drum. A shoulder extends radially from the distal end of the auxiliary drum. A guide guides the pull cord such that the end portion of the pull cord is wound on the auxiliary drum and that the winding turns are pushed to move along the auxiliary drum toward the winding drum under the effect of the shoulder.

The aforementioned conventional winding device is disadvantageous in that the winding turns tend to overlap with each other while being formed when the number of winding turns is relatively large. This results in entanglement of the winding turns when the winding turns are unwound from the winding device.

SUMMARY OF THE INVENTION

Therefore, the object of the present invention is to provide a winding device that is capable of overcoming the aforesaid drawbacks of the prior art.

According to the present invention, a winding device, which is applied to a window blind, includes a headrail, a winding drum, a pull cord, a carriage member, and a guide member. The headrail extends in a longitudinal direction. The winding drum extends in the longitudinal direction, is mounted on the headrail, is operable so as to rotate relative to the headrail, and has a threaded drum portion, and a smooth drum portion that extends from the threaded drum portion. The pull cord extends through the headrail, and is secured to the smooth drum portion of the winding drum. The carriage member threadedly engages the threaded drum portion, and is movable along the threaded drum portion in a first axial direction when the winding drum is rotated in a first rotational direction so as to wind the pull cord on the smooth drum portion of the winding drum, and in a second axial direction opposite to the first axial direction when the winding drum is rotated in a second rotational direction opposite to the first rotational direction so as to unwind the pull cord from the smooth drum portion of the winding drum. The guide member is coupled to the carriage member so as to be co-movable therewith, and has a distal end distal from the carriage member, and connected to and in sliding contact with the pull cord so as to guide the pull cord such that winding turns of the pull cord on the smooth drum portion of the winding drum are formed adjacent to one another without overlapping.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
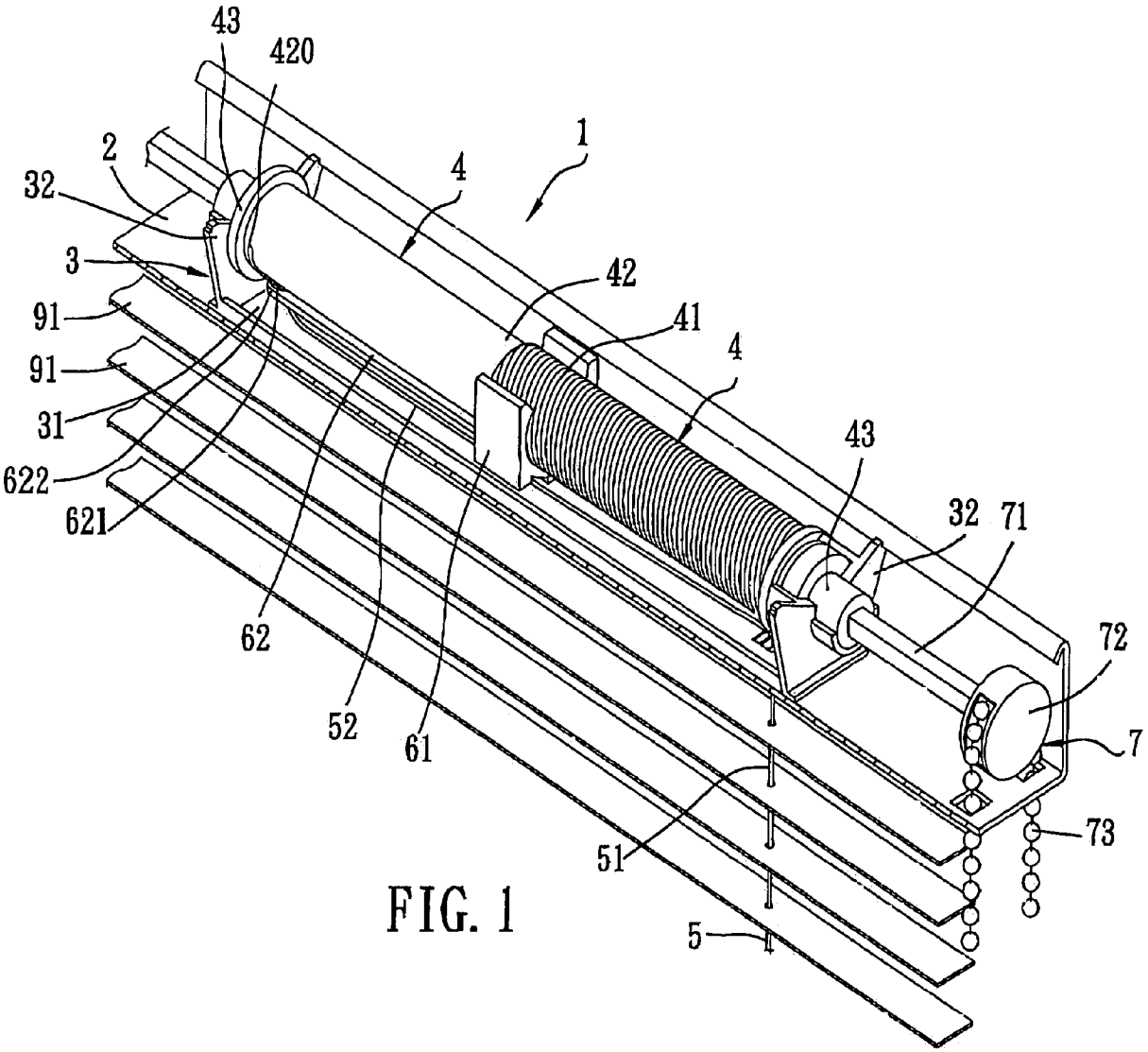
FIG. 1 is a perspective view of the first preferred embodiment of a winding device according to the present invention.

Before the present invention is described in greater detail, it should be noted that like elements are denoted by the same reference numerals throughout the disclosure.

Figure 2:
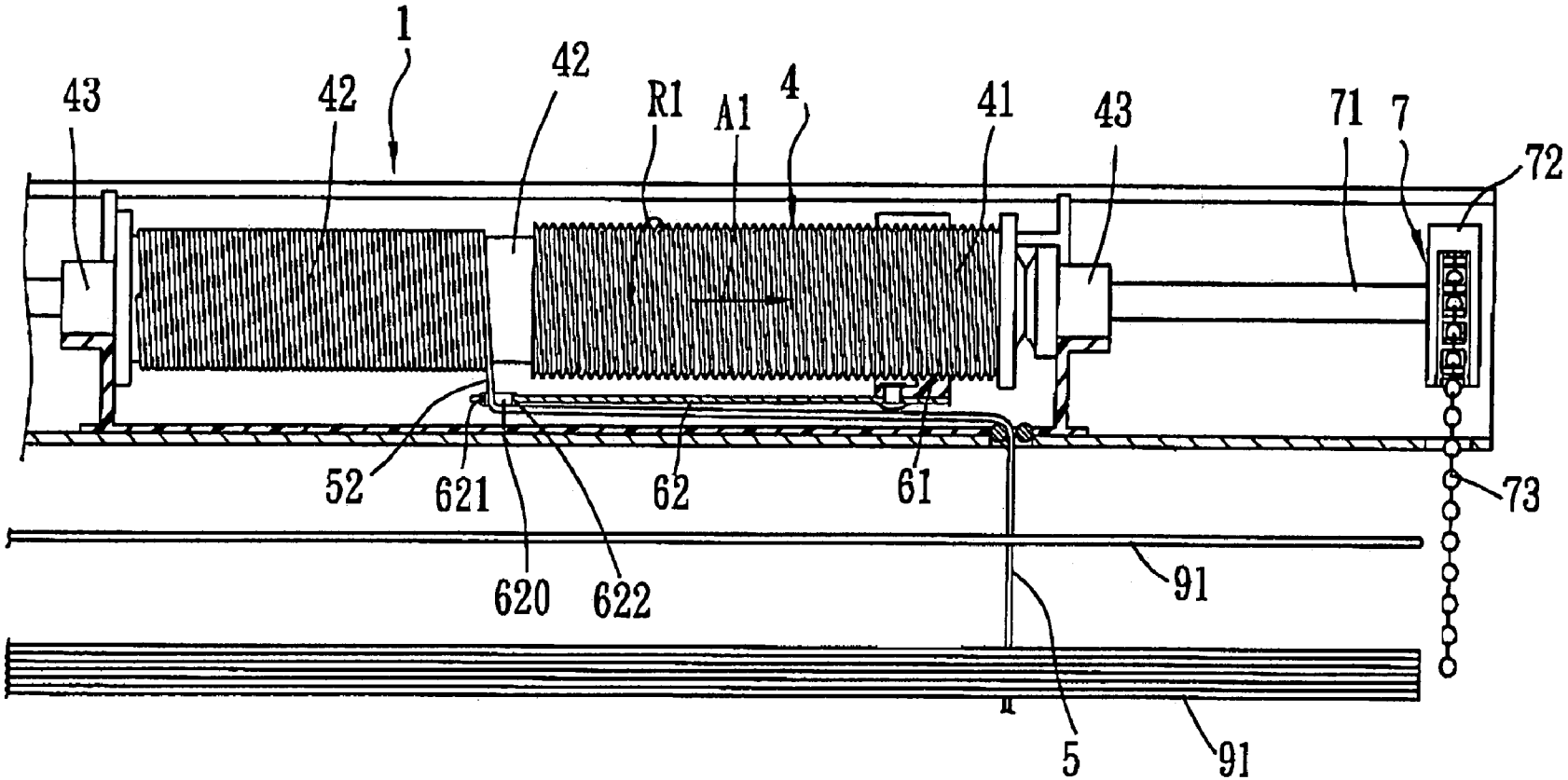
FIG. 2 is a schematic view of the first preferred embodiment to illustrate a state where a pull cord is wound on a winding drum.
Figure 3:
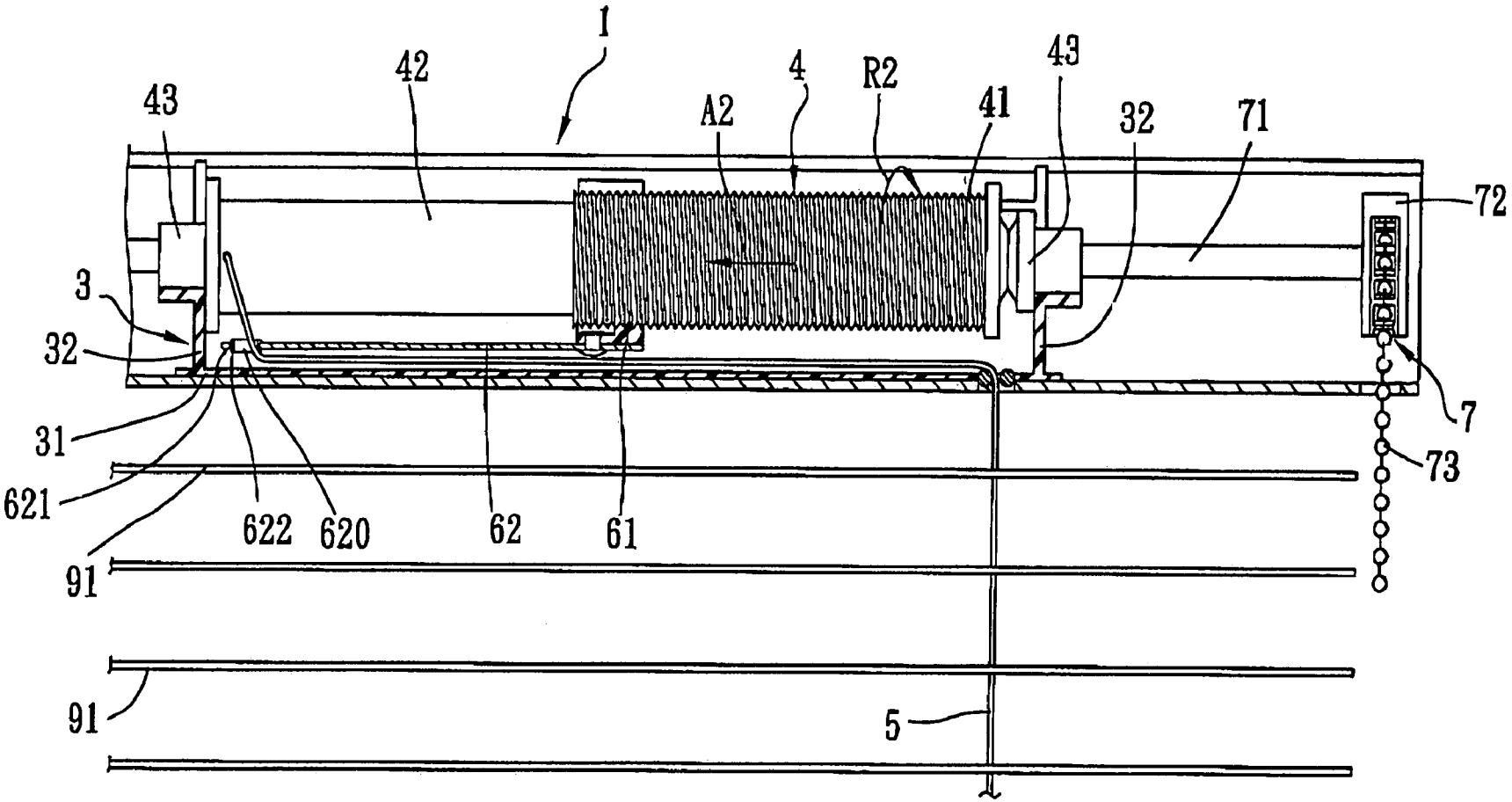
FIG. 3 is a schematic view of the first preferred embodiment to illustrate a state where the pull cord is unwound from the winding drum.

Referring to FIGS. 1 to 3, the first preferred embodiment of a winding device 1 according to this invention is shown to include a headrail 2, a winding drum 4, a pull cord 5, a carriage member 61, and a guide member 62.

The winding device 1 is applied to a window blind, such as a Venetian blind, that includes a plurality of slats 91 disposed under and parallel to the headrail 2, and a bottom rail (not shown) disposed under and parallel to the slats 91.

The headrail 2 extends in a longitudinal direction, and is adapted to be mounted on a wall (not shown) above a window (not shown).

The winding drum 4 extends in the longitudinal direction, is mounted on the headrail 2, and has a threaded drum portion 41, and a smooth drum portion 42 that extends from the threaded drum portion 41. In this embodiment, the winding drum 4 is operable so as to rotate relative to the headrail 2. Moreover, the winding drum 4 is made from a plastic material. Further, the threaded drum portion 41 and the smooth drum portion 42 are formed in a single piece.

The pull cord 5 is operable so as to raise and lower the slats 91. In particular, the pull cord 5 has a lower end portion 51 that extends through the slats 91 and that is connected to the bottom rail, and an upper end portion 52 that is opposite to the lower end portion 51, that extends through the headrail 2, and that is secured to the smooth drum portion 42 of the winding drum 4. It is noted that, the smooth drum portion 42 of the winding drum 4 is formed with a hole 420 therethrough. The upper end portion 52 of the pull cord 5 is secured to the smooth drum portion 42 by extending the upper end portion 52 of the pull cord 5 through the hole 420 and then by subsequently forming a knot (not shown) at the upper end portion 52 of the pull cord 5.

The carriage member 61 is U-shaped, and has a pair of vertical arms, and a horizontal arm that interconnects the vertical arms. The arms of the carriage member 61 are formed with a screw thread that threadedly engages the threaded drum portion 41 of the winding drum 4. As best shown in FIG. 2, the carriage member 61 is movable along the threaded drum portion 41 in a first axial direction, as indicated by the arrow (A1), when the winding drum 4 is rotated in a first rotational direction, as indicated by the arrow (R1), so as to wind the pull cord 5 on the smooth drum portion 42 of the winding drum 4. As best shown in FIG. 3, the carriage member 61 is further movable in a second axial direction, as indicated by the arrow (A2), opposite to the first axial direction when the winding drum 4 is rotated in a second rotational direction, as indicated by the arrow (R2), opposite to the first rotational direction so as to unwind the pull cord 5 from the smooth drum portion 42 of the winding drum 4. It is noted that the carriage member 61 is limited by the headrail 2 against rotation when the winding drum 4 is rotated.

The guide member 62 extends from the carriage member 61, is coupled to the horizontal arm of the carriage member 61 so as to be co-movable therewith, and has a distal end 621 that is distal from the carriage member 61, and that is connected to and that is in sliding contact with the pull cord 5. In this embodiment, the guide member 62 is operable so as to guide the pull cord 5 such that winding turns of the pull cord 5 on the smooth drum portion 42 of the winding drum 4 are formed adjacent to one another without overlapping. Preferably, the guide member 62 is made from metal. Alternatively, the guide member 62 may be made from plastic. The distal end 621 of the guide member 62 is formed with a guiding hole 620. The upper end portion 52 of the pull cord 5 extends through the guiding hole 620. The guide member 62 is provided with a ring 622 that is disposed in the guiding hole 620, and that surrounds and that is in sliding contact with the pull cords, thereby minimizing the friction between the pull cord 5 and the distal end 621 of the guide member 62.

The winding device 1 further includes a driving mechanism 7 that drives rotation of the winding drum 4, and that includes a horizontal shaft 71, a rotary wheel 72, and a drive cord 73. The horizontal shaft 71 extends in the longitudinal direction through the winding drum 4, is coupled to the winding drum 4 so as to be co-rotatable therewith, and is journalled within the headrail 2. The rotary wheel 72 is sleeved securely on the horizontal shaft 71 so as to be co-rotatable therewith. The drive cord 73 extends through the headrail 2, is connected to the rotary wheel 72, and is operable so as to drive rotation of the rotary wheel 72. Since the feature of this invention does not reside in the specific configuration of the driving mechanism 7, which is conventional in construction, a detailed description thereof is omitted herein for the sake of brevity.

The winding device 1 further includes a bracket 3 that supports the winding drum 4. The bracket 3 includes a horizontal bracket part 31 that is disposed underneath the winding drum 4 and that has opposite ends, and a pair of vertical bracket parts 32, each of which extends from a respective one of the opposite ends of the horizontal bracket part 31. The winding drum 4 has opposite ends, each of which is provided with a shank 43 that is journalled on a respective one of the vertical bracket parts 32.

In operation, when it is desired to raise the slats 91 from an initial first position, where the slats 91 are lowered (see FIG. 3), the drive cord 73 is operated to drive rotation of the rotary wheel 72 in the first rotational direction. This results in rotation of the horizontal shaft 71 in the first rotational direction, which, in turn, results in rotation of the winding drum 4 in the first rotational direction and winding of the pull cord 5 on the smooth drum portion 42. At the same time, the rotation of the winding drum 4 enables axial movement of the carriage member 61 along the threaded drum portion 41 in the first axial direction. The movement of the carriage member 61 is transmitted to move the guide member 62 to guide winding of the pull cord 5 on the smooth drum portion 42 such that winding turns are formed next to one another (see FIG. 2) without overlapping.

Since operation of lowering the slats 91 is similar to the operation of raising the slats 91, a detailed description thereof is omitted herein for the sake of brevity.

It is noted that since the winding turns are formed next to one another during the raising operation of the slats 91, the winding turns does not entangle with each other during the lowering operation of the slats 91.

It is also noted that when the slats 9 are obstructed during the lowering operation of the slats 91, this causes loosening of the winding turns and accumulation of the loosened winding turns on the smooth drum portion 42. At an instant the obstruction is removed, the slats 91 drop abruptly, and by virtue of the smooth surface of the smooth drum portion 42, the loosened winding turns unwind easily from the smooth drum portion 42 without entanglement.

It is further noted that in this embodiment, the threaded and smooth drum portions 41, 42 have the same diameter. In an alternative embodiment, the threaded and smooth drum portions 41, 42 have different diameters.

Figure 4:
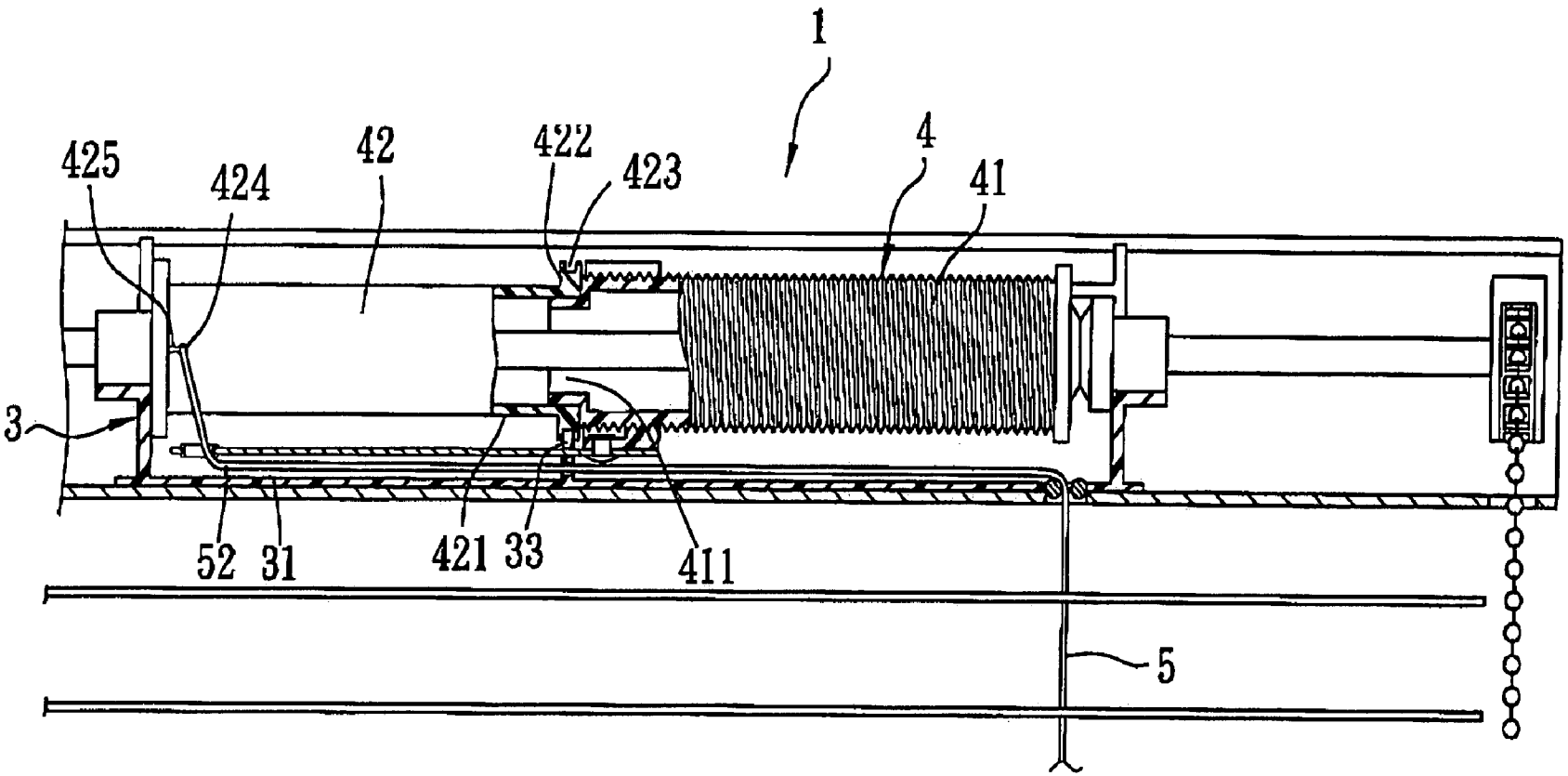
FIG. 4 is a schematic view of the second preferred embodiment of a winding device according to the present invention.

FIG. 4 illustrates the second preferred embodiment of a winding device 1 according to this invention. When compared with the previous embodiment, the threaded and smooth drum portions 41, 42 of the winding drum 4 are separate entities and are connected to each other through connecting means in particular, the threaded drum portion 41 has a coupling end 411 that has a diameter smaller than that of the smooth drum portion 41. The smooth drum portion 42 has a coupling end 421 that is sleeved fittingly on the coupling end 411 of the threaded drum portion 41.

Moreover, the smooth drum portion 42 has a flange 422 that is formed on the coupling end 421 thereof and that defines an annular groove 423. The bracket 3 further includes a protrusion 33 that extends from the horizontal bracket part 31 into the annular groove 423, and that supports the junction of the coupling end 411 of the threaded drum portions 41 and the coupling end 421 of the smooth drum portion 42.

Further, the smooth drum portion 42 is formed with, instead of the hole 420, a connecting groove 424, and is further formed with a slit 425 that is tapered toward and that is in spatial communication with the connecting groove 424. In securing the pull cord 5 to the connecting groove 424, the upper end portion 52 of the pull cord 5 is formed with a knot. The knot is slid along the slit 425 into the connecting groove 424, and is anchored on a periphery of the connecting groove 424. It is noted that the junction of the slit 425 and the connecting groove 424 has a width that is less than the diameter of the connecting groove 424.

Figure 5:
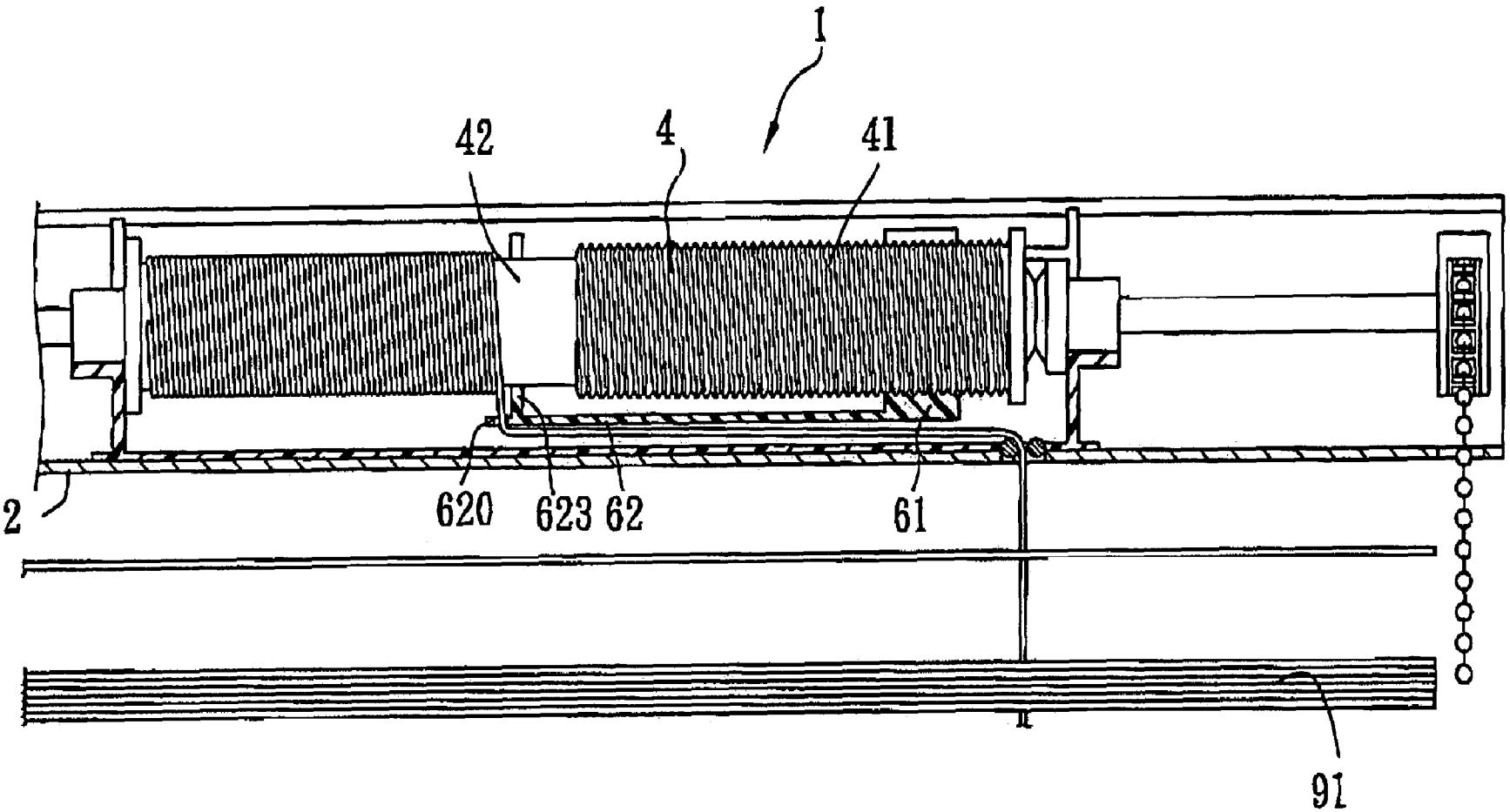
FIG. 5 is a schematic view of the third preferred embodiment of a winding device according to the present invention.
Figure 6:
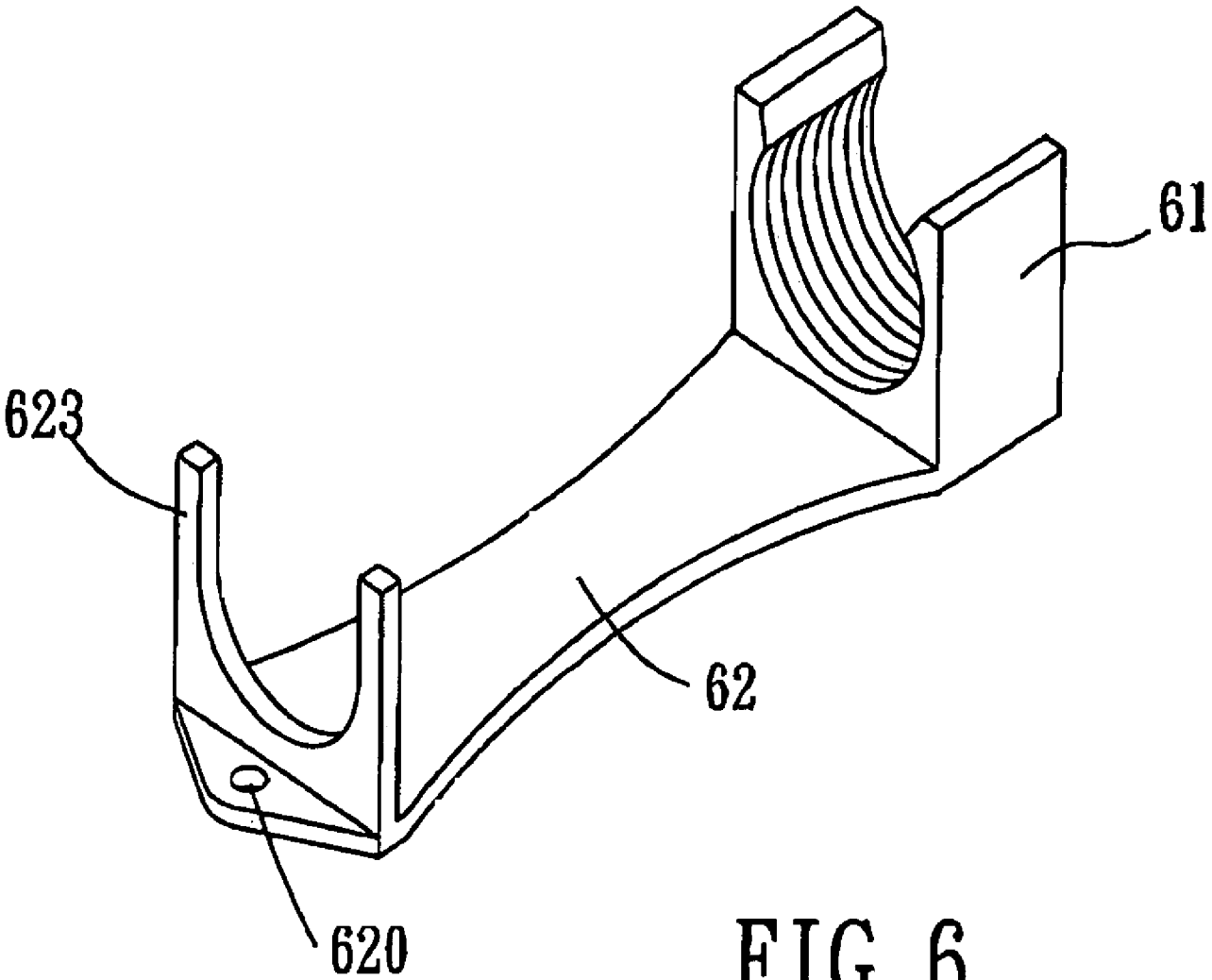
FIG. 6 is a perspective view to illustrate a carriage member, a guide member, and a limiting member of the third preferred embodiment.

FIGS. 5 and 6 illustrate the third preferred embodiment of a winding device 1 according to this invention. When compared with the first preferred embodiment, the guide member 62 is provided with a limiting member 623 that is limited by the winding drum 4 so as to prevent sideward movement of the guide member 62 relative to the winding drum 4 during the raising operation of the slats 91. In particular, the limiting member 623 extends from the guide member 62, is disposed adjacent to the guiding hole 620, is U-shaped, and has a pair of vertical arms, and a horizontal arm that interconnects the vertical arms. The arms of the limiting member 623 are in sliding contact with the smooth drum portion 42 without hindering the axial movement of the carriage member 61 along the threaded drum portion 41, and rotation of the winding drum 4 relative to the headrail 2.

While the present invention has been described in connection with what is considered the most practical and preferred embodiments, it is understood that this invention is not limited to the disclosed embodiments but is intended to cover various arrangements included within the spirit and scope of the broadest interpretations as to encompass all such modifications and equivalent arrangements.

What is claimed is:

1. A winding device for a window blind, comprising:

a headrail extending in a longitudinal direction;

a winding drum extending in the longitudinal direction, mounted on said headrail, operable so as to rotate relative to said headrail, and having a threaded drum portion, and a smooth drum portion extending from said threaded drum portion;

a pull cord that extends through said headrail, and that is secured to said smooth drum-portion of said winding drum;

a carriage member threadedly engaging said threaded drum portion, and movable along said threaded drum portion in a first axial direction when said winding drum is rotated in a first rotational direction so as to wind said pull cord on said smooth drum portion of said winding drum, and in a second axial direction opposite to the first axial direction when said winding drum is rotated in a second rotational direction opposite to the first rotational direction so as to unwind said pull cord from said smooth drum portion of said winding drum; and a guide member coupled to said carriage member so, as to be co-movable therewith, and having a distal end distal from said carriage member, and connected to and in sliding contact with said pull cord so as to guide said pull cord such that winding turns of said pull cord on said smooth drum portion of said winding drum are formed adjacent to one another without overlapping.

2. The winding device as claimed in claim 1, wherein said distal end of said guide member is formed with a guiding hole, said pull cord extending through said guiding hole.

3. The winding device as claimed in claim 1, further comprising a driving-mechanism for driving rotation of said winding drum, said driving mechanism including a horizontal shaft that extends in the longitudinal direction through said winding drum, that is coupled to said winding drum so as to be co-rotatable therewith, and that is journalled within said headrail, a rotary wheel that is sleeved securely on said horizontal shaft so as to be co-rotatable therewith, and a drive cord that extends through said headrail, that is connected to said rotary wheel and that is operable so as to drive rotation of said rotary wheel.

4. The winding device as claimed in claim 2, wherein said guide member is provided with a ring that is disposed in said guiding hole, and that surrounds and that is in sliding contact with said pull cord.

5. The winding device as claimed in claim 1, wherein said smooth drum portion and said threaded drum portion are formed in a single piece.

6. The winding device as claimed in claim 5, further comprising a bracket for supporting said winding drum, said bracket including a horizontal bracket part that is disposed underneath said winding drum and that has opposite ends, and a pair of vertical bracket parts, each of which extends from a respective one of said opposite ends of said horizontal bracket part said winding drum having opposite ends, each of which is journalled on a respective one of said vertical bracket parts.

7. The winding device as claimed in claim 6, wherein said smooth drum portion has a coupling end that is coupled to said threaded drum portion, and a flange that is formed on said coupling end and that defines an annular groove, said bracket further including a protrusion that extends from said horizontal bracket part and into said annular groove.

8. The winding device as claimed in claim 1, wherein said smooth drum portion is formed with a connecting groove, said pull cord having an end secured in said connecting groove.

9. The winding device as claimed in claim 8, wherein said smooth drum portion is further formed with a slit that is tapered toward and that is in spatial communication with said connecting groove.

10. The winding device as claimed in claim 1, wherein said guide member is provided with a limiting member for limiting sideward movement of said guide member, said limiting member extending from guide member and being in sliding contact with said smooth drum portion.

* * * * *